US007351123B1

(12) United States Patent
Winiecke

(10) Patent No.: US 7,351,123 B1
(45) Date of Patent: Apr. 1, 2008

(54) ELECTRICAL TERMINAL SPLICE

(76) Inventor: Devin Winiecke, 10831 Lowden St., Stanton, CA (US) 90680

( * ) Notice: Subject to any disclaimer, the term of this patent is extended or adjusted under 35 U.S.C. 154(b) by 0 days.

(21) Appl. No.: 11/708,964

(22) Filed: Feb. 21, 2007

(51) Int. Cl.
*H01R 11/11* (2006.01)

(52) U.S. Cl. ..... 439/883

(58) Field of Classification Search ..... 439/883, 439/868, 791, 792, 801, 907
See application file for complete search history.

(56) References Cited

U.S. PATENT DOCUMENTS

| | | | | |
|---|---|---|---|---|
| 1,019,423 | A * | 3/1912 | Case | 439/868 |
| 1,650,295 | A * | 11/1927 | Patten | 439/868 |
| 2,522,672 | A * | 9/1950 | Graham | 403/326 |
| 4,795,380 | A * | 1/1989 | Frantz | 439/860 |
| 5,203,724 | A * | 4/1993 | Casey | 439/792 |
| 6,530,795 | B2 * | 3/2003 | Maeda et al. | 439/287 |
| 6,960,723 | B2 * | 11/2005 | Fujii et al. | 174/84 C |

OTHER PUBLICATIONS

Web page, Imperial Supplies LLC, Battery Terminals, Jan. 22, 2007, 2 pgs., www.imperialinc.com/grp015-2.shtml.
Web page, Imperial Supplies LLC, Battery Terminals, 3/0 Magna Lug RH ELB 3/8"STUD, Jan. 22, 2007, 1 pg., www.imperialinc.com/items.asp?item-0063040.
Web page, 3M United States, 3M Scotchiok Copper One Hole Lug 30041, Orange, 3/0 AWG, 10 per case, Dec. 27, 2006, 1 pg., http://products3,3m/catalog/us/en001/government/innovative_solutions/node_GSBX3PY8HMgs/root.

* cited by examiner

*Primary Examiner*—Neil Abrams
*Assistant Examiner*—Harshad C Patel
(74) *Attorney, Agent, or Firm*—Gary M. Anderson, Esq.; Fulwider Patton LLP

(57) ABSTRACT

A terminal splice for the electrical connection and termination of multiple electrical conduits using a center lug with a hollow body including depressions and a mounting flange attached to the body projecting longitudinally outward and obliquely therefrom and positioned between and fastened to the mounting flanges of two side lug housings in a disposition projecting the center lug body and side lug flanges in parallel from the mounting point.

19 Claims, 6 Drawing Sheets

ELECTRICAL TERMINAL SPLICE

BACKGROUND OF THE INVENTION

1. Field of the Invention

This invention relates to the field of electrical terminations.

2. Description of the Prior Art

Electrical connections are commonly used in numerous applications ranging from household appliances to large industrial applications. It is appreciated that in some applications, space is at a premium and electrical wiring is often employed within harsh physical environments.

Common within many industrial electrical connections are the conjunction of two or more electrical components whose wires are connected together by terminal splices. Splices may be routinely used in industrial applications were one electrical component must be wired to a power line fed by a power source. Typically a load is provided to discrete components that are both disconnective and interchangeable providing the ability to disconnect separate pieces for maintenance or replacement. The maintenance of such components is often within a housing such as a motor connection box that conveniently organizes the wires leading from various components, preventing the wires from splaying out unprotected into the environment.

Motor connection boxes are designed to hold the wires within a confined setting and require an efficient use of space. The boxes often have a limited area where wires must be run close together in order to prevent undesirable contact and pressure on adjacent wires and components. Working within the motor boxes and other areas requiring electrical wiring, often involves working within a heated environment with limited movement for the body. Multiple wires and wiring systems are often located within the same motor box within close vicinity of each other. For example, wiring may be located within an oil refinery where several pieces of heavy equipment require connection within each and adjacent machines.

Electrical wires may commonly be spliced together within electrical confines using electrical splice termination lugs providing organization and direction to the wire lines. One currently available electrical splice lug can be seen at www.imperialinc.com/grp015-2.shtml item 0063040. Another currently available electrical splice lug is the 3M™ Scothlock™ one hole lug (part No. 30041). When three or more lugs of this type are used, the bodies of each lug may contact an adjacent lug tangentially in interference, causing two of the lugs to project at an acute angle away from the third lug. Like many similar electrical splice lugs, lugs of such a design suffer from the fact that wires inserted into the lug interiors are subjected to stress and compression against edge of the lug body when more than two of such lug types are connected together. The shape and configuration of such lugs, when connected together, as shown in FIG. 1, often forces the wires to enter inside the lug at acute angles creating both gaps between the wires and stress points where wires contact the lug edge. As will be appreciated, stress and wear on the wires is compounded when the various components often require periodic maintenance and disconnection. Movement, disconnection and reconnection contribute to fatigue and stress on the wires where the wire rub against the lug edges and may fray after periodic disconnection or replacement of components.

As understood by those of ordinary skill in the art, the problems with the commercial terminal lugs available in the market today are magnified when industrial applications of increased magnitude require wires of increasingly thicker diameters to provide sufficient load to components. Typical industrial applications use a wire gauge ranging from a number 2 AWG (American Wire Gauge) to a No. 1/0 cable to even larger 1000 MCM cables (MCM is the electrical manufacturing industry representation for thousand circular mils). When major components require relatively larger diameter cables, electrical terminal splice lugs with larger hollow bodies are required. Some electrical connections may also necessitate the splicing of wires with disparate diameters. The larger the splice lugs and the wider the lug differential, the more pronounced the angle and gaps created between the three lug bodies. Consequently, as shown in FIG. 1, the angle in which two of the three wires entering the two angled lugs subjects the wires to a proportional degree of stress and compression against the lug body edges. As will be recognized, as the diameter of the wire increases and the angle of entry into the lug bodies becomes larger, gaps formed between the three entering wires is magnified.

Some electrical terminal splice lugs commonly available also suffer from contributing to an inefficient usage of space at the terminal connection. As will be recognized, one technique often incorporated into the finish of a terminal splice is the insulation of the splice connection by wrapped electrical tape. Once a workman finishes mounting the three electrical terminations together, electrical tape is wrapped around both the exterior circumference of the connection and within the gaps formed between the lugs and around the wires. Connections involving larger diameter wires will sometimes result in a softball size mass of electrical tape insulation surrounding the termination. When the workman is required to disconnect the electrical lines for maintenance or replacement of electrical components, the workman must cut into the softball size webbing of electrical tape at various points, including the tape wrapped around individual strands of wire. As will be appreciated, the need to cut into various surfaces of electrical tape surrounding the termination lead to an increase in time and labor expended in working with electrical termination splice assemblies.

SUMMARY OF THE INVENTION

Briefly and in general terms, the present invention comprises a plurality of terminal splice connectors consisting of a center lug confined between two side lugs. The center lug includes a hollow body and a mounting flange projecting away from the hollow body. The two side lugs also include respective hollow bodies with mounting flanges projecting therefrom. The terminal splice is arranged so that the side lug flanges are mounted on either side of the center lug flange at a mounting point with the bodies of respective side and center lugs projecting in parallel from the mounting point. Conduits are attached to the interior of the respective lug bodies so that when the terminal splice is arranged with the center lug connected to the two side lugs, the conduits also project from respective lugs in a parallel relationship.

The center lug consists of a hollow body with a mounting flange extending axially from the body along the longitudinal axis and angled therefrom. The body includes a pair of depressions formed on either side of the mounting flange base to provide clearance for the mounting flanges and bodies of respective side lugs.

The side lugs include a generally cylindrical hollow body and a mounting flange extending offset from the longitudinal axis of the body and projecting tangential to the body surface. The side lugs form a mating configuration with the center lug by positioning the outward facing surface of each side lug mounting flange in direct abutment on each side of the center lug mounting flange and are fastened together. In this position, the center and side lug bodies project from the fastening in a parallel relationship.

Other features and advantages of the invention will become apparent from the following detailed description, taken in conjunction with the accompanying drawings which illustrate, by way of example, the features of the invention.

DETAILED DESCRIPTION OF THE PREFERRED EMBODIMENTS

Figure 1:
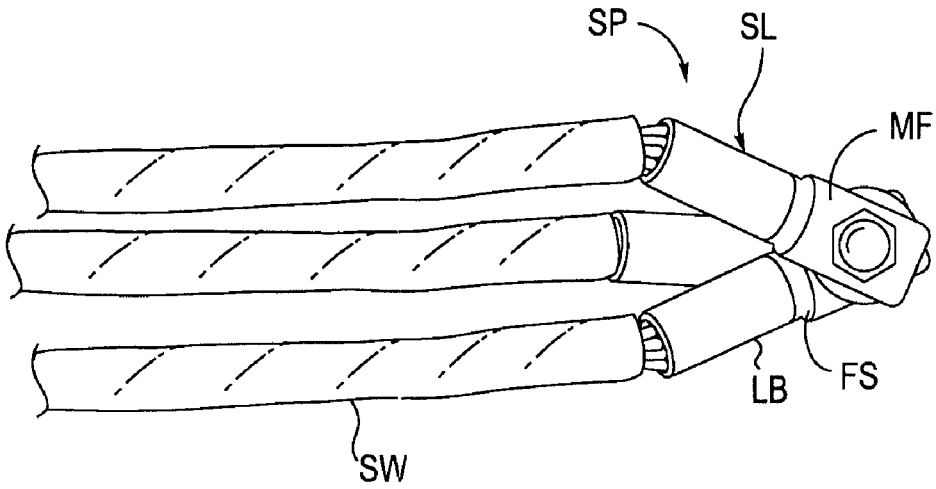
FIG. 1 (Prior Art)
FIG. 1 is a top plan view of the prior art.

In the field of electrical wiring, and specifically in terminating electrical connections comprising multiple wires, a common termination technique used is the splice. An example of an electrical termination using three commercially available splice lugs or caps SL is shown in FIG. 1. Each splice lug SL includes a mounting flange MF attached off center from the lug body LB by a perpendicularly projecting shoulder FS causing the flange to project generally tangential to the body outer surface. When more than two wire terminations are connected together by such prior art lugs, the resulting splice may create a gap between the spliced wires and cause frictional contact and a stress point where the wire enters the lug interiors.

Figure 2:
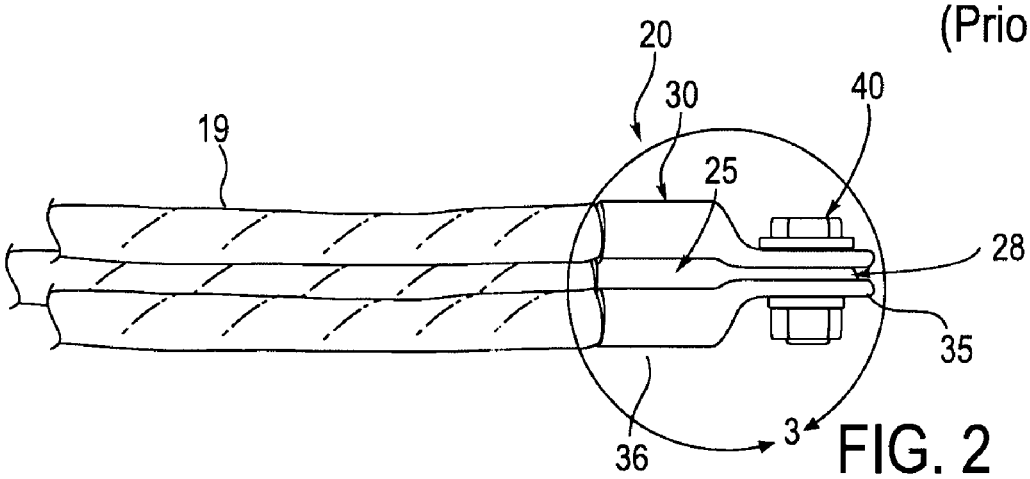
FIG. 2 is a front plan view of the terminal splice embodying the present invention.

As will be appreciated by those skilled in the art, these electrical terminations are sometimes made within compact electrical box confines using wires and cables of differing gauges where the gaps may become more pronounced when larger gauge wire or cable is used. To solve this problem the Applicant has developed a modified terminal splice 20 as shown in FIG. 2. The terminal 20 splice for the present invention includes a center lug 25 and side splice lugs 30 positioned adjacent the center lug 25. The center lug 25 includes a center lug mounting flange 28 and the side lugs 30 include respective side lug mounting flanges 35, the center and side lug flanges mounted together by a fastener 40. Sheathed wires 19 extend axially outward from each of the lugs. As will be understood, sheathed wires 19 may interchangeably switch between electrical wires and cabling depending on the application. As shown in FIG. 2, the respective lugs are positioned such that wires 19 extend in a generally parallel disposition, preferably in contact with one another, minimizing the gaps between wires and tension on respective wires entering the lug interiors.

Figure 4:
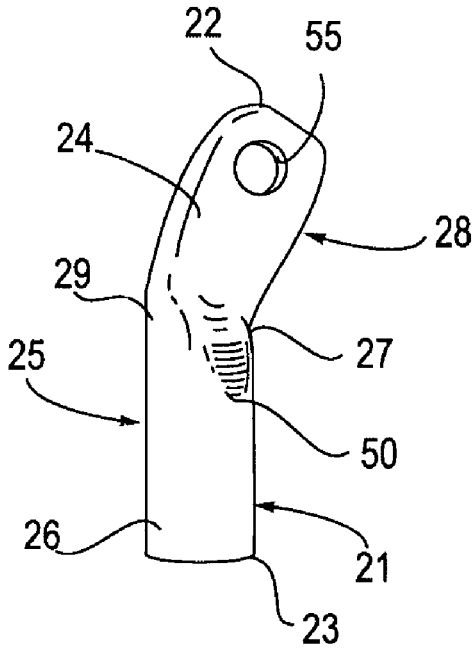
FIG. 4 is perspective view of the center lug of the terminal splice shown in FIG. 2.
Figure 5:
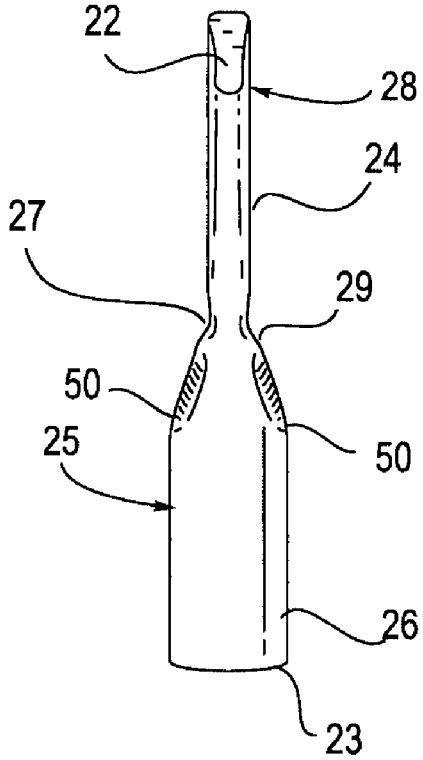
FIG. 5 is a front view of the center lug of the terminal splice shown in FIG. 2.
Figure 6:
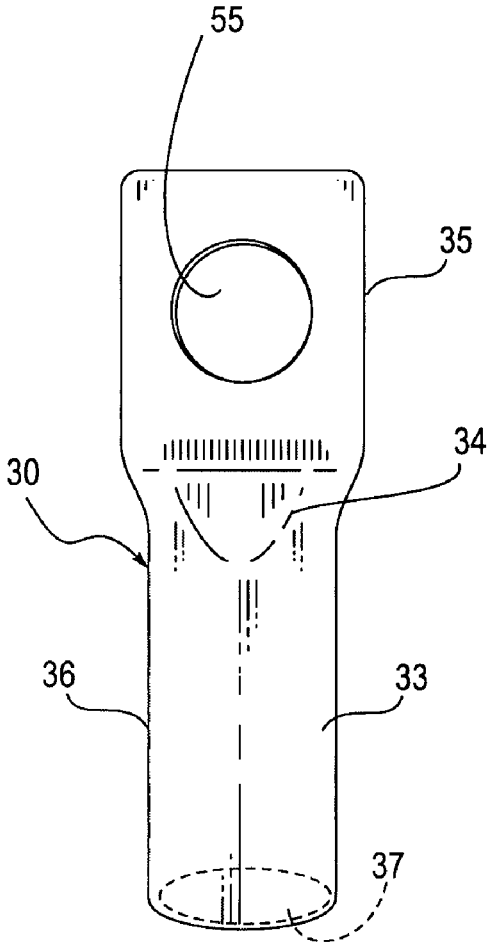
FIG. 6 is a side view of a side lug of the terminal splice shown in FIG. 2.
Figure 7:
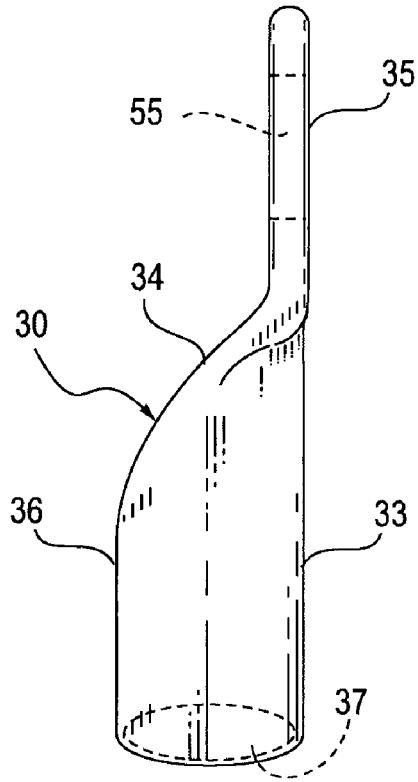
FIG. 7 is a front view of a side lug of the terminal splice shown in FIG. 2.

As described herein, the center lug 25 and side lugs 30 are particularly suited to create a generally parallel projection of wires entering the lugs and a reduction of stress on the wires. Referring to FIGS. 4 and 5, the center lug 25 includes a mounting flange 28 extending longitudinally outward and angled away from the longitudinal axis of the lug body 21. The lug body 21 includes an exterior surface 26 and an open center lug end 23. The mounting flange 28 is formed on the end opposite the lug end 23 with a thickness thinner than the circumference of the body 21 and includes mounting flange surfaces 24 on both sides of the mounting flange 28 with a mounting bore 55 provided therethrough and terminates in a mounting flange end 22. It will be recognized that the flange 28 may be formed by flat pressing one end of the lug body 21 or by attaching a flange member to one end of the lug body 21. The intersection of the mounting flange 28 and the lug body 21 is defined by a center lug mounting flange base 27 and shoulders 29 formed on both sides of the center of the body 21. The lug body 21 may also include depressions 50 along the exterior surface 26 placed below and on either side of the mounting flange 28. The center lug body 21 includes elements such as the surface 24, shoulders 29 and depressions 50 being symmetric about the circumference of the body as seen best in FIG. 5.

Figure 3:
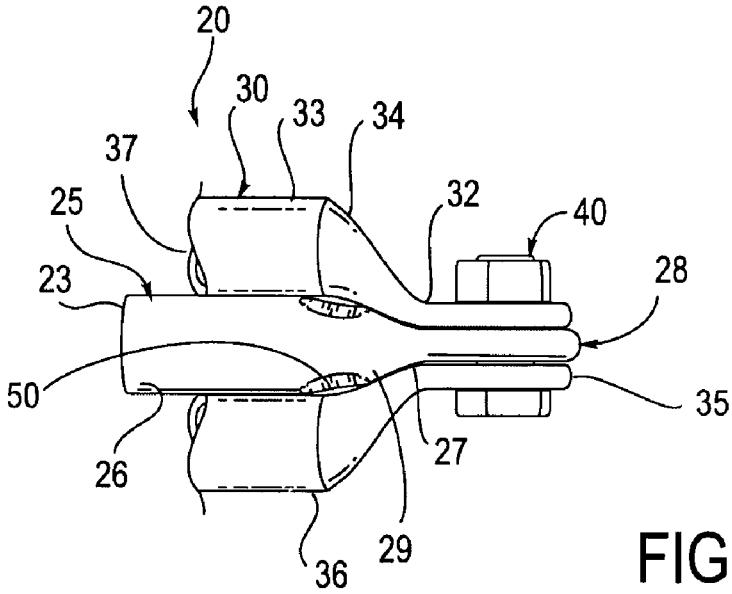
FIG. 3 is a detailed sectional view in enlarged view taken from the circle designed 3 in FIG. 2.

As shown in FIG. 3, the side lugs 30 represent electrical lugs that are commercially available and the center lug 25 is formed to adapt to and create a more efficient splice connection in cooperation with exemplary side lugs 30. Referring to FIG. 3, the side lugs 30 include a side lug mounting flange 35 connected to a side lug body 33 defined by a generally cylindrical surface 36 with the connection between the mounting flange and body defined by a side lug mounting flange base 32 and side lug mounting flange shoulder 34. As will be recognized, commercially available side lugs of this type may be formed with the side mounting flange 35 projecting from the shoulder 34 off-center from the longitudinal axis of the side lug body 33 and projecting longitudinally from the tangential side of the surface 36. Mounting bores (not shown) are provided in mounting flanges 35.

Figure 8:
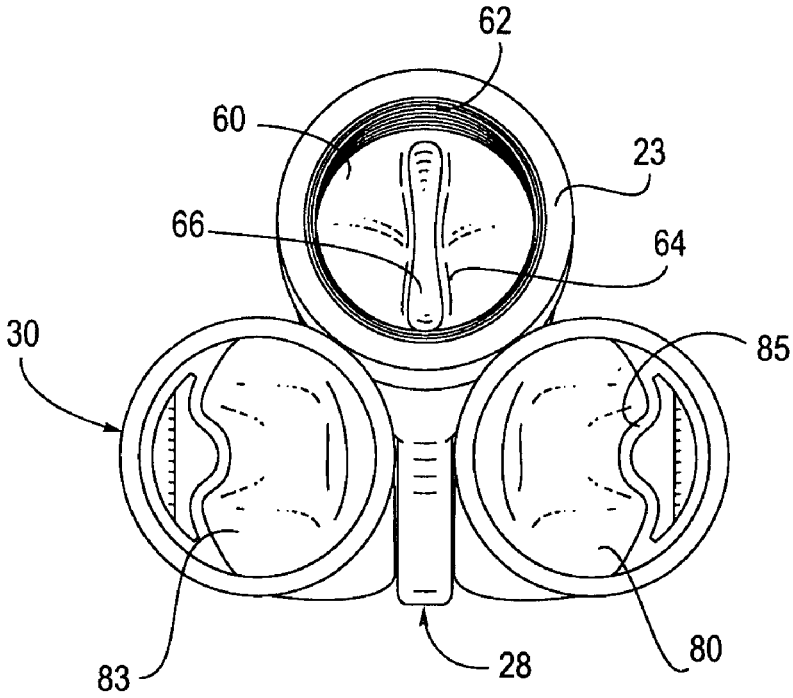
FIG. 8 is an end view of the terminal splice shown in FIG. 2.

Referring to FIG. 8, the center lug 25 includes a center lug open lug end 23 incorporating a hollow center lug interior 60. The center lug interior 60 may include a frictional surface 62 and a lip 64 formed within the interior surface 60 defining the origination of a mounting flange interior 66. Side lugs 30 include respective hollow interiors 80, including a side lug interior lip 83 and surface 85.

In operation, side lugs 30 are positioned around center lug 25 so that side lug mounting flanges 35 surround the center lug mounting flange 28 in conductive connection. In one embodiment (FIGS. 2-4), the side lug mounting flanges 35 are positioned flush against the center lug surfaces 24 of respective sides of the mounting flange 28 and are connected together by a bolt and nut combination 40 passing through mounting bores on the respective mounting flanges. The center lug mounting flange 28 extends angled from the longitudinal axis of the center lug body 21, providing an offset clearance for the side lug shoulders 34 and side lug bodies 33 to abut the center lug shoulders 29 and body 21 when the side lug mounting flanges 35 are positioned on opposing sides of the center lug mounting flange. As will be appreciated, depressions 50 formed on the center lug body 21 provide clearance for the generally cylindrical surface 36 of the adjacent side lug bodies 33 as the lugs are fastened together and the respective lug bodies abut one another. Furthermore, as the side lug mounting flanges 35 are positioned against the center lug mounting flange 28, it will be appreciated that centering the mounting flange 28 along the longitudinal axis of lug body 21 provides a symmetric abutment of side mounting flanges 35 to the center lug mounting flange 28. Further augmenting the compact configuration of the terminal splice are the shoulders 29 formed on the center lug body 21 at the center lug mounting flange base 27, shaped to provide both clearance and align respective side lug mounting flange bases 32 and shoulders 34 into place as these portions rest against respective support members.

As shown in FIGS. 2 and 8, wires 19 are fitted within lug ends 23 and 37 of the center and side lugs into respective lug interiors 60 and 80. Those skilled in the art recognize that proper crimping of an inserted conduit with the correct compression die and tool around the lug body provides the primary retention of conduits. Yet, further retention of the wires 19 within the center lug 25 may be augmented by a frictional surface 62, such as by forming a threaded groove, affording an additional frictional component inhibiting disconnection of the wire 19 from within the interior 60 of lug 25.

Figure 9:
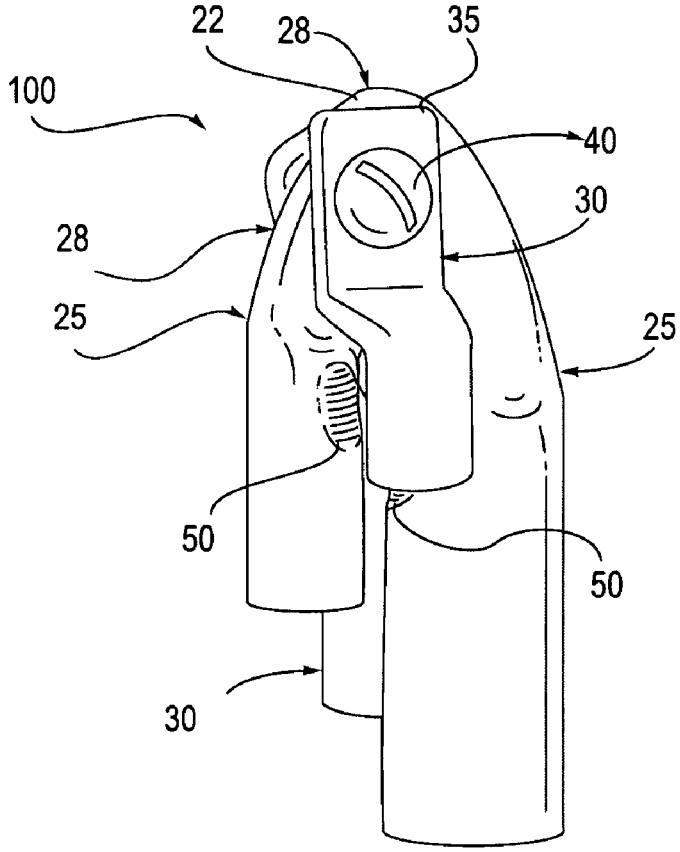
FIG. 9 is a perspective view of a second embodiment of the present invention.

With reference to FIG. 9, a second embodiment is shown similar to the embodiment depicted in FIG. 2 except that, a second center lug 25 is attached to the splice 100. It will be recognized that adding additional center lugs 25 affords multiple connections beyond the three terminal connection, shown in FIG. 2. In terminal splices that require more than three connections, multiple center lugs 25 may be mounted together between book end side lugs 30 by alternating the orientation of respective mounting flanges 28 of respective center lugs 25. Similar to the arrangements shown in FIGS. 2-3, terminal splices required for more connections can be created by abutting together the mounting flanges 28 of respective center lugs 25 with the center lug flanges angling toward one another. It will be appreciated that the close knit abutment of the center lug bodies 21 and adjacent side lug bodies 33 provide once again, a parallel projection of the conduits 19 from respective lug interiors.

With reference to FIG. 9, a third embodiment is shown incorporating the splice 20 in cooperation with a motor connection box assembly 90. It will be further appreciated that such an electrical terminal splice 20 is particularly suited for use in large-scale industrial applications such as power plants, refineries and water pumping situations and will be advantageous for electrical connections where efficiency in the amount of spaced used is at a premium. For example, the terminal splice 20 may be used with large industrial compression motors capable of producing 4000 to 6000 hp, where the diameter of such sheathed wires 19 may be mismatched and are often bulky and cumbersome. One diameter size sometimes used is a 250 MCM conductor, but it is understood by those skilled in the art that smaller and larger gauge wire sizes will be used depending on the application and source of the wires. Referring to FIGS. 8 and 9, motor boxes 90 housed in a casing 91 sometimes incorporate dual-voltage motors 97 with paired T-leads 96 originating from the motor and manipulated for electrical connection to a larger diameter feeder wire 94 that is fed in through the casing.

Figure 10:
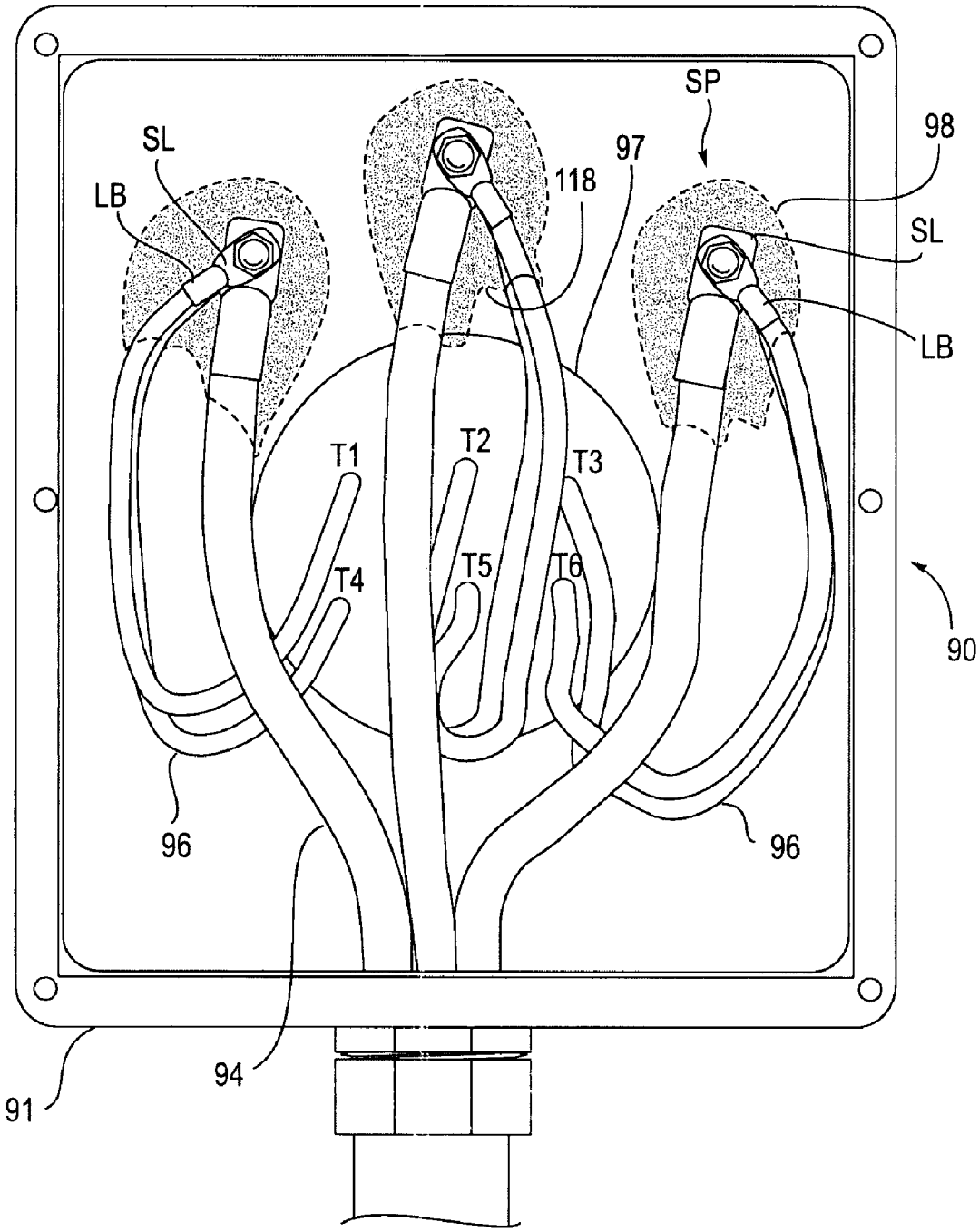
FIG. 10 (Prior Art)
FIG. 10 is a top plan view of the prior art.
Figure 11:
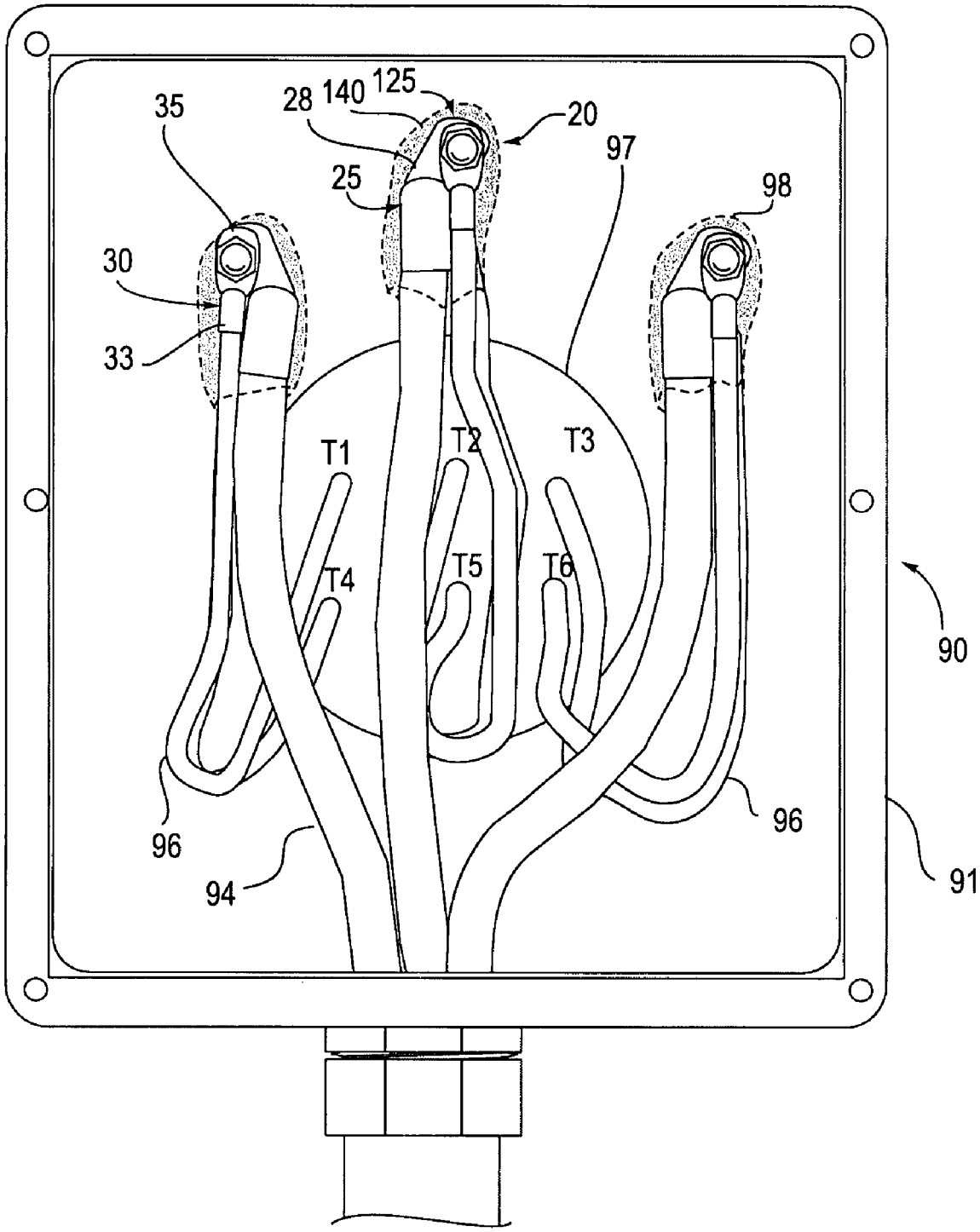
FIG. 11 is a top plan view of a third embodiment of the invention.

In the prior art (FIG. 10), the T-leads 96 are often bent manipulating the T-lead splice lugs SL for positioning about both sides of a feeder line splice lug SL. It will be understood that the T-lead and feeder line terminal splice lugs are of similar construction. The lug bodies LB of adjacent splice lugs SL may sometimes abut creating what some may consider an undesirable gap 118 between lines 96 and feeder wire 94 and their respective splice lugs SL.

It will also be appreciated that the maintenance required on these wires is often performed in close quarters in a heated environment and that the splice 20 is conducive for reducing time spent on disconnection and reconnecting the spliced wire ends. The resulting terminal splice SP of the prior art (FIG. 10) is often insulated by layers of electrical rubber tape that is wound both around the overall splice and in between the individual T-leads and feeder wire multiple times. Those skilled in the art will recognize that manipulating the prior art connection between these three wires and their insulation may often require a half hour for the connection of a single splice resulting in a softball sized fused webbing of insulation 98 that may require several incisions from a sharp utility blade wielded within the obstructed confines of the motor connection box casing 91 for removal. Furthermore, the length of the T-leads 96 and feeder wires 94 will be subjected to a reacting tensional force created by the abutting lug bodies LB biasing the length of the lines and wires to further spread from each other, which the skilled workman can appreciate may in some cases cause a diffuse entanglement of wiring within the tight confines of the motor connection box 90 further adding stress to the cutting and removal of insulating material 98 from the prior art terminal splice SP.

It will be appreciated that the terminal splice 20, as seen in FIG. 9, incorporating the terminal center lug 25 and using an offset center lug mounting flange 28 provides a well-organized and safer work environment for the electrician workman. It will be recognized that the center lug mounting flange 28 provide clearance for adjacent terminal lugs 30 beneficial for the routing of lines 96 and wire 94 in compact engagement leading to the splice 20. The feeder wire 94 may be connected to the center lug 25, where the flange 29 extends longitudinally from the lug body 21 and angles away from the longitudinal axis. T-leads 96 may be connected to side lugs 30 whose mounting flange 35 is often projecting longitudinally from the side lug body 33 offset from the longitudinal axis. The side lug bodies 33 abut the center lug body 21 permitting the respective lug bodies to project from the terminal splice connection point 125 substantially parallel which in respect permits routing of respective leads 96 and wires 94 to approach the terminal splice 20 in concurrent parallel unison. It will be further appreciated that the resulting terminal splice 20 requires only a thin layer of insulating tape 98 wrapped around the splice perimeter that the workman may easily slice open when disconnection for repairs and maintenance is desired. As will also be appreciated, the terminal splice 20 also provides a compact and fairly predictable termination size where insulating the resulting terminal splice affords the workman the use of standardized rubber capping boots 140 providing a cleaner and more efficient insulation technique. In such cases, the workman caps the electrical lines with lugs, positions and fastens together the lugs, and caps the lug assembly with a snug boot finishing the splice termination in a relatively quick, clean, and safe manner.

Those of ordinary skill in the art will appreciate that minor modifications and alterations will be possible without deviating from the scope of the invention, and said modifications and alterations are intended to be included in the scope of the invention.

I claim:

1. An electrical terminal splice of three or more wires in electrical connection, comprising:

a center lug including a hollow body projecting along a longitudinal axis, first and second ends and an interior surface, the first end including an opening operative for insertion of one of respective wires into contact with the interior surface, the second end including a center lug mounting flange projecting longitudinally from the hollow body and angled from the longitudinal axis thereof;

a pair of side lugs, each side lug having a hollow housing, said housing including an open end operative for receiving an electrical wire within said housing, said housing further including a mounting end formed with a side lug mounting flange projecting therefrom;

at least one depression formed on the center lug body adjacent the center lug mounting flange operative to provide clearance for respective side lug housings; and the center lug mounting flange positioned between the side lug mounting flanges and fastened thereto at a mounting point disposed to project the body and housings in a generally parallel relationship from the mounting point.

2. The electrical terminal splice of claim 1, wherein:

the side lugs each include a circumferential exterior; and the side lug mounting flanges each project tangentially from respective circumferential exteriors.

3. The terminal splice of claim 1, wherein:

respective side lugs include respective shoulders connecting respective mounting flanges to respective side lug housings; and the center lug includes a pair of support shoulders in operative support respective side lug shoulders.

4. The terminal splice of claim 1, wherein:

the center lug mounting flange and side lug flanges include respective mounting bores and further include a fastener fastening the center and side lugs together.

5. The terminal splice of claim 1, wherein:

the center lug flange is disposed flush against each side lug flange.

6. The terminal splice of claim 1, wherein:

the center lug interior surface is formed with at least one lip operative to grip the conduit.

7. The terminal splice of claim 1, wherein:

a rubber insulating cap positioned around the center mounting flange and side lug mounting flanges.

8. An electrical terminal splice of two or more wires in electrical connection, comprising:

a center lug including a hollow body projecting along a longitudinal axis, first and second ends and an interior surface, the first end including an opening operative for insertion of one of respective wires into contact with the interior surface, the second end including a center lug mounting flange projecting longitudinally from the hollow body and angled from the longitudinal axis thereof;

at least one side lug having a hollow housing including an open end operative for receiving an electrical wire within the housing and further including a mounting end formed with a side lug mounting flange projecting therefrom;

at least one depression formed on the center lug body adjacent the center lug mounting flange operative to provide clearance for respective side lug housings; and the center lug mounting flange positioned in abutment with at least one side lug mounting flange and fastened thereto at a mounting point disposed to project the center lug body and side lug housing in a generally parallel relationship from the mounting point.

9. A splice cap for holding the end of a wire and fastening to an adjacent cap body, comprising:

a cylindrical hollow body including a first and second end;

a flange mounted diametrically centered to the first end defining a flange base, the flange further mounted projecting longitudinally away from the body;

one or more depressions positioned adjacent the flange base operative to provide clearance for the adjacent cap body; and the second end providing an entrance for passage of the wire into the hollow body.

10. The splice cap of claim 9, wherein:

the flange projects angling away from the body.

11. The splice cap of claim 10, wherein:

the flange projects in a range of 30° to 45° from the longitudinal axis of the body.

12. The splice cap of claim 9, wherein:

the mounting flange includes first and second mounting sides, a dorsal edge, a ventral edge, and a top edge, the dorsal edge projecting toward the ventral edge; and the hollow body includes first and second body sides defined by the mounting flange, the first and second body sides corresponding to the first and second mounting sides.

13. The splice cap of claim 12, wherein:

a pair of the depressions are formed on the first and second body sides formed to converge toward the ventral edge and the flange base.

14. The splice cap of claim 12, wherein:

the first and second body sides include respective shoulders positioned adjacent said pair of depressions.

15. The splice cap of claim 9, wherein:

the hollow body includes an interior surface formed with a tractional component operative to create a frictional force with the wire.

16. The splice cap of claim 15, further comprising:

a pair of lips positioned within the interior surface in contact with the wire.

17. The splice cap of claim 9, wherein:

the cap and wire are conductive.

18. The splice cap of claim 9, further comprising:

a crimp formed intermediately between the first and second end defining the base of the mounting flange.

19. A compressor unit including an electrical connection for use within a motor connection box, comprising:

a motor;

at least three electrical lines including line ends in electrical connection with the motor leading into the motor connection box; and an electrical splice in the motor connection box including at least one center cap including a center cap housing for housing one of the electrical line ends, the center cap housing further including a least two depressions formed on said housing operative to provide clearance for side housings and a center lug mounting flange projecting longitudinally from the center cap housing and angled from the longitudinal axis thereof, the splice further including respective side lugs with side lug housings and flanges positioned on respective sides of the center cap mounting flange and fastened thereto at a mounting point disposed to project respective housings in a generally parallel relationship from the mounting point, the side lugs each respectively housing another electrical line.

* * * * *

UNITED STATES PATENT AND TRADEMARK OFFICE

CERTIFICATE OF CORRECTION

PATENT NO. : 7,351,123 B1
APPLICATION NO. : 11/708964
DATED : April 1, 2008
INVENTOR(S) : Devin Winiecke It is certified that error appears in the above-identified patent and that said Letters Patent is hereby corrected as shown below:

Column 1, line 62, delete “wire” and insert --wires--.

Column 5, line 48, delete “spaced” and insert --space--.

Column 8, line 54, delete “a least” and insert --at least--.

Signed and Sealed this

Nineteenth Day of August, 2008

JON W. DUDAS
*Director of the United States Patent and Trademark Office*